US007765620B2

(12) United States Patent
Belouin

(10) Patent No.: US 7,765,620 B2
(45) Date of Patent: Aug. 3, 2010

(54) BELT SUPPORT

(76) Inventor: Sean J. Belouin, 11307 Church Bend Ct., Germantown, MD (US) 20876

( * ) Notice: Subject to any disclaimer, the term of this patent is extended or adjusted under 35 U.S.C. 154(b) by 351 days.

(21) Appl. No.: 12/000,697

(22) Filed: Dec. 17, 2007

(65) Prior Publication Data

US 2009/0151053 A1 Jun. 18, 2009

(51) Int. Cl.
*A41F 9/00* (2006.01)

(52) U.S. Cl. ..... 2/319; 2/337

(58) Field of Classification Search ..... 2/319, 2/316, 317, 318, 320, 322, 337; 24/31 R, 24/31 F, 3.12, 198, 306, 191, 182
See application file for complete search history.

(56) References Cited

U.S. PATENT DOCUMENTS

| | | | | |
|---|---|---|---|---|
| 544,596 | A | 8/1895 | Simmons et al. | |
| 697,811 | A | 4/1902 | Conway | |
| 728,414 | A * | 5/1903 | Rhoads | 24/350 |
| 848,732 | A | 4/1907 | Eisman | |
| 934,290 | A | 9/1909 | Dalmar et al. | |
| 1,374,971 | A * | 4/1921 | Wiener | 2/337 |
| 1,414,048 | A * | 4/1922 | Schlutz | 24/499 |
| 1,495,925 | A * | 5/1924 | Quertermous | 24/182 |
| 1,532,671 | A | 4/1925 | Bennett | |
| 1,566,016 | A | 12/1925 | Johnson et al. | |
| 1,589,228 | A * | 6/1926 | Robb | 24/532 |
| 1,600,684 | A * | 9/1926 | McGibbon | 24/543 |
| 1,682,536 | A * | 8/1928 | Otten | 24/3.13 |
| 2,023,194 | A | 12/1935 | Dann | |
| 2,528,854 | A * | 11/1950 | Burk et al. | 24/369 |
| 3,034,189 | A * | 5/1962 | Twentier | 2/322 |
| 3,069,691 | A * | 12/1962 | Svojse | 2/337 |
| 3,158,916 | A | 12/1964 | Percin | |
| 3,184,760 | A | 5/1965 | Anstey et al. | |
| 3,251,108 | A * | 5/1966 | Harrison | 24/166 |
| 3,710,391 | A * | 1/1973 | McGlynn | 2/460 |
| 3,866,276 | A | 2/1975 | Perkins | |
| 3,983,604 | A * | 10/1976 | Phillips | 24/16 PB |
| 4,038,726 | A * | 8/1977 | Takabayashi | 24/198 |
| 4,040,147 | A * | 8/1977 | King | 24/353 |
| 4,356,599 | A * | 11/1982 | Larson et al. | 24/16 PB |
| 4,358,036 | A * | 11/1982 | Maltais | 224/667 |
| 4,486,904 | A | 12/1984 | Gonce et al. | |
| 4,520,536 | A | 6/1985 | Hata | |
| 4,619,020 | A * | 10/1986 | Lecher, Sr. | 24/10 A |
| 4,627,132 | A * | 12/1986 | Markham | 24/169 |
| 4,757,927 | A * | 7/1988 | Rutty | 224/673 |
| 4,825,475 | A | 5/1989 | Smart | |
| 5,152,013 | A * | 10/1992 | Johnson | 2/321 |
| 5,159,730 | A * | 11/1992 | Radvin | 24/543 |
| 5,176,106 | A * | 1/1993 | Casto et al. | 119/865 |
| 5,251,361 | A * | 10/1993 | Owens et al. | 24/182 |
| 5,441,188 | A * | 8/1995 | Rosenstein | 224/264 |
| 5,483,704 | A * | 1/1996 | Filipiak | 2/336 |
| 5,548,878 | A * | 8/1996 | Romagnoli | 24/306 |
| 5,577,395 | A * | 11/1996 | Kuykendall | 63/3 |
| 5,608,918 | A * | 3/1997 | Salvaggio | 2/421 |

(Continued)

*Primary Examiner*—Alissa L Hoey
(74) *Attorney, Agent, or Firm*—Welsh & Flaxman LLC

(57) ABSTRACT

A belt support for supporting a belt in position along a waist-band adjacent a wait band clasp includes a first belt support member and a second belt support member adjustably mounted upon the first belt support member for movement relative thereto.

9 Claims, 4 Drawing Sheets

U.S. PATENT DOCUMENTS 5,640,742 A * 6/1997 White et al. ..... 24/3.12
5,819,379 A * 10/1998 Van Hout et al. ..... 24/182
5,920,964 A * 7/1999 Malzahn ..... 24/182
5,979,019 A * 11/1999 Johnson ..... 24/3.11
6,209,766 B1 * 4/2001 Kwon ..... 224/269
7,181,808 B1 * 2/2007 Van Winkle ..... 24/191
7,406,789 B2 * 8/2008 Story ..... 40/633
2008/0313861 A1 * 12/2008 Clifton, Jr. ..... 24/3.12

* cited by examiner

BELT SUPPORT

BACKGROUND OF THE INVENTION

1. Field of the Invention

The invention relates to a belt support. More particularly, the invention relates to an adjustable belt support apparatus adapted to position and maintain a belt buckle in position relative to the waistband and waistband clasp at the top of the pants or skirt upon which the belt is positioned.

2. Description of the Related Art

Sagging of a belt and belt buckle can occur from a variety of causes. For example, if an individual has a stomach that presses outward on a pair of pants, the belt and belt buckle can thrust downward giving the appearance of a sagging belt and belt buckle. This may occur if a person is overweight. Another cause of a belt and belt buckle sagging downward can be due to the softness and slipperiness of pants fabric against the belt and belt buckle, where the fabric of the pants and belt do not grip each other, causing the belt and belt buckle to once again sag downward. A third cause of a belt and belt buckle sagging downward can be a loose belt. Tightening of the belt too much can cause discomfort to the belt user. Thus, loosening of the belt relieves the discomfort, however, the result can be a sagging belt and belt buckle. A fourth cause of a belt and belt buckle sagging downward can be due to various accoutrements hanging from the belt, for example, cell phones, pagers, other communication devices, tools, etc.

Although various devices have been developed in an effort to confront these problems, a need still exists for a device capable of supporting a belt and belt buckle in a convenient and effective manner. The present invention provides such an apparatus and secures the front of the belt and belt buckle parallel to the top edge of the waistband of the pants.

SUMMARY OF THE INVENTION

It is, therefore, an object of the present invention to provide a belt support for supporting a belt in position along a waistband adjacent a wait band clasp. The belt support includes a first belt support member and a second belt support member adjustably mounted upon the first belt support member for movement relative thereto. The first belt support member includes a substantially straight first long arm having a first end and a second end, a substantially straight second long arm having a first end and a second end, a first connecting member coupled between the second end of the first long arm and the second end of the second long arm with the first long arm and the second long arm substantially parallel. The first long arm, second long arm and connecting member form a recess shaped and dimensioned for receiving a waistband and belt adjacent a waistband clasp. The first belt support member includes a first telescoping member shaped and dimensioned for telescopically engaging the second belt support member. The second belt support member includes a first end and a second end. The first end of the second belt support member includes a second telescoping member shaped and dimensioned for telescopically coupling with the first telescoping member of the first belt support member to allow movement of the second belt support member relative to the first belt support member. A belt engaging flange extends from the second end of the second belt support member and toward the second long arm of the first belt support member. The belt engaging flange is shaped and dimensioned to wrap about the belt for holding it in position adjacent the waistband. The first telescoping member frictionally engages the second telescoping member for permitting controlled adjustment of the second belt support member relative to the first belt support member.

It is also an object of the present invention to provide a belt support wherein the first belt support member is resilient.

It is another object of the present invention to provide a belt support wherein the first end of the first long arm includes spring biased arm.

It is a further object of the present invention to provide a belt support wherein the spring biased arm includes a smooth inner surface.

It is also an object of the present invention to provide a belt support wherein the spring biased arm includes a ribbed inner surface.

It is still another object of the present invention to provide a belt support wherein the first telescoping member is a longitudinally extending first telescoping arm.

It is yet another object of the present invention to provide a belt support wherein the second telescoping member includes a recess shaped and dimensioned for receiving the first telescoping arm.

It is a further object of the present invention to provide a belt support wherein the first telescoping arm includes a detent shaped and dimensioned to engage a crimp along the second telescoping member for preventing separation of the first telescoping arm from the second telescoping member.

It is also an object of the present invention to provide a belt support wherein the belt engaging flange includes a front wall, a base and a rear wall forming a recess.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
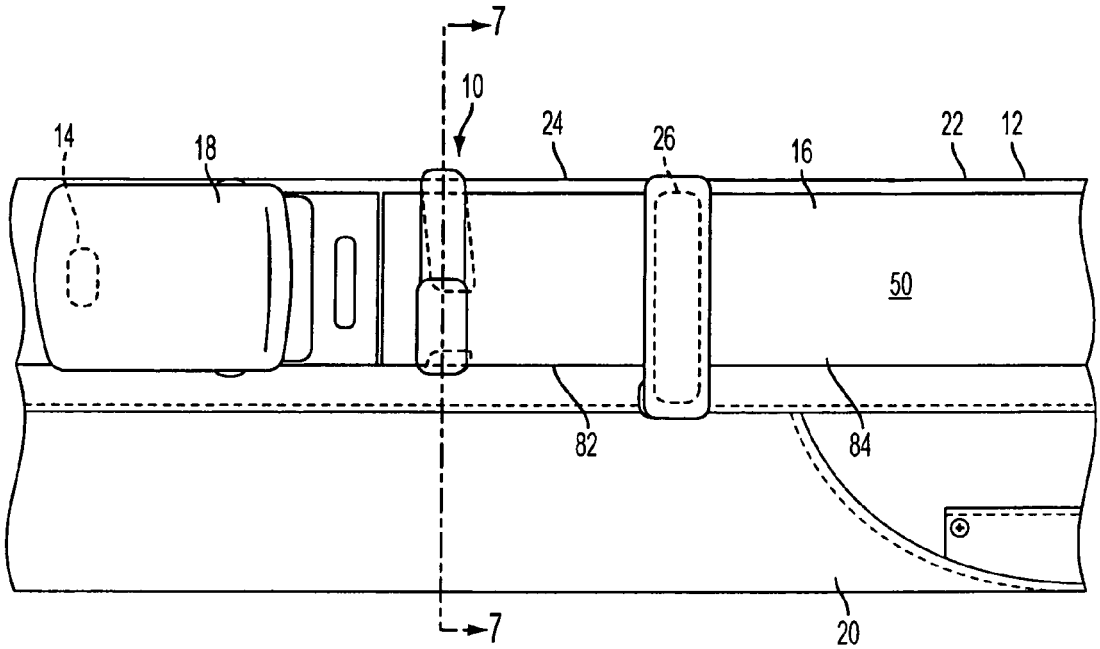
FIG. 1 is a perspective view of the present belt support utilized in conjunction with a belt along the waistband of a pair of pants.
Figure 2A:
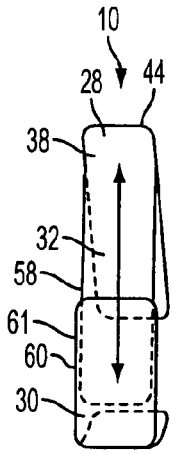
FIGS. 2A and 2B respectively show a front plan view and a side plan view of the belt support.
Figure 2B:
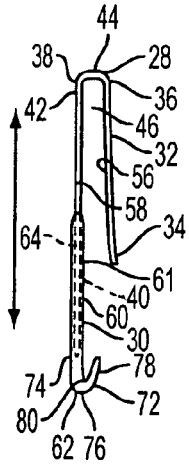
Figure 3:
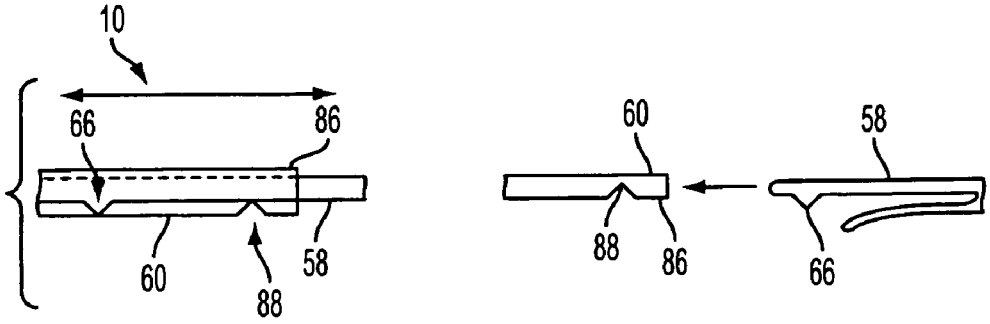
FIG. 3 shows a detailed view of the telescoping members utilized in conjunction with the present belt support.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to the various figures, a belt support 10 for supporting a belt 16 in position along a waistband 12 adjacent a waistband clasp 14 is disclosed. As those skilled in the art will certainly appreciate, the present belt support 10 may be used in supporting a belt 16 and associated belt buckle 18 along a waistband 12 on either a pair of pants, a skirt, or other apparel 20 where it is desirable to ensure the belt 16 and belt buckle 18 are properly positioned along a waistband 12 without allowing the belt buckle 18 and front of the belt 16 to dip downwardly along the front of the waistband 12 adjacent the waistband clasp 14.

The present belt support 10 is a small utility device whose function is to secure a belt 16 and belt buckle 18 substantially parallel to the top edge 22 of a waistband 12 of a pair of pants 20, preventing the front of the belt 16 and belt buckle 18 from sagging downward.

Those skilled in the art will certainly appreciate waistbands come in a variety of constructions and the present belt support 10 may certainly be adapted to accommodate the various waistbands constructions. For the purpose of describing the present invention, it will be described as used with a waistband 12 for a pair of pants 20 wherein the waistband 12 is positioned at the upper edge 24 of the pants 20. The waistband 12 includes a top edge 22, which is also the upper edge 24 of the pants 20 and is the transition point between the pants 20 and a shirt that might be tucked into the pants 20. The waistband 12 also includes central waistband clasp 14 positioned at the front of the pants 20 for securing the pants 20 about the waist of an individual. The waistband 12 is further provided with a plurality of belt loops 26 along the waistband 12 for supporting the belt 16 as it is wrapped about the waist of the wearer. However, the belt loops 26 are not positioned directly adjacent the waistband clasp 14 and, therefore, a belt 16 and belt buckle 18 has a tendency to "dip down" adjacent the waistband clasp 14.

As will be discussed below in substantial detail, the present belt support 10 is designed to support the belt 16, and in particular, the belt buckle 18, adjacent the waistband clasp 14 for ensuring that the belt 16 will stay in position along the waistband 12 and will be substantially aligned with the top edge 22 of the waistband 12 as it extends about the waist of the wearer.

The belt support 10 generally includes a first belt support member 28 and a second belt support member 30 adjustably mounted upon the first belt support member 28 for movement relative thereto. The first belt support member 28 includes a substantially straight first long arm 32 having a first end 34 and a second end 36, a substantially straight second long arm 38 having a first end 40 and a second end 42, a first connecting member 44 coupled between the second end 36 of the first long arm 32 and the second end 42 of the second long arm 38 with the first long arm 32 and the second long arm 38 substantially parallel.

The first long arm 32, second long arm 38 and the first connecting member 44 form a recess 46 shaped and dimensioned for receiving the waistband 12 and belt 16 adjacent a waistband clasp 14. In particular, and as will be discussed below in greater detail, the recess 46 is placed over the top edge 22 of the waistband 12 such that the first long arm 32 is positioned along the inner surface 48 of the waistband 12, the second long arm 38 is positioned along the outer surface 50 of the belt 16 and the first connecting member 44 sits upon the top edge 22 of the waistband 12. In this way the belt support 10 sits upon the waistband 12 and is supported upon the top edge 22 of the waistband 12.

Figure 4A:
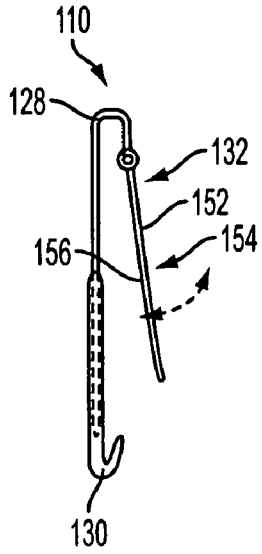
FIGS. 4A and 4B are respectively side plan views of alternate embodiments of the belt support in accordance with the present invention.
Figure 4B:
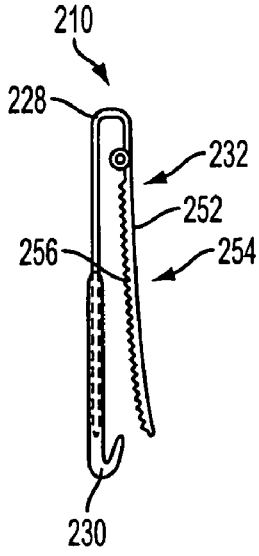
Figure 5:
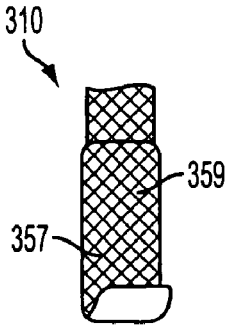
FIG. 5 is a detailed plan view showing an alternate embodiment in accordance with the present invention.
Figure 6A:
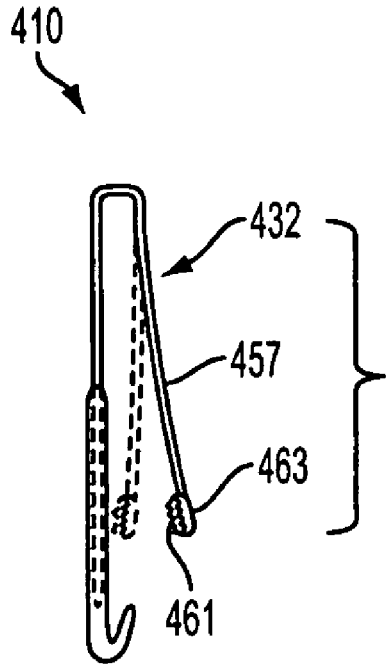
FIGS. 6A, 6B, 6C and 6D respectively show a side plan view, a detailed view of the inner surface of the first long arm, a perspective view with the first long arm open and a perspective view with the first long arm closed in accordance with an alternate embodiment.
Figure 6B:
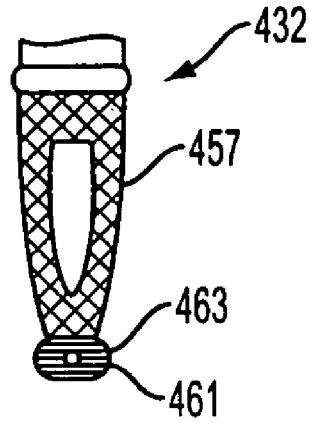
Figure 6C:
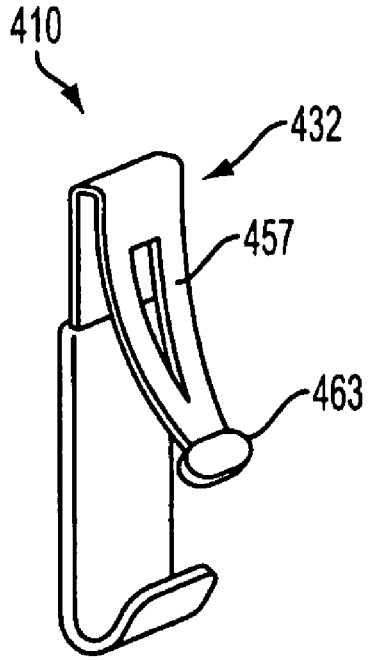
Figure 6D:
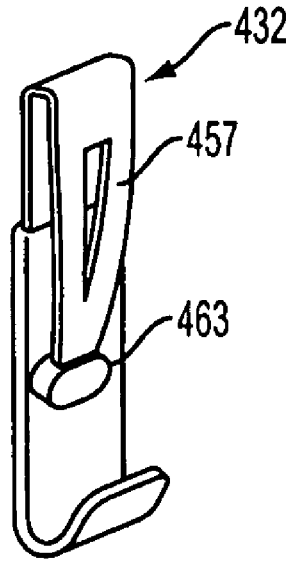
Figure 7:
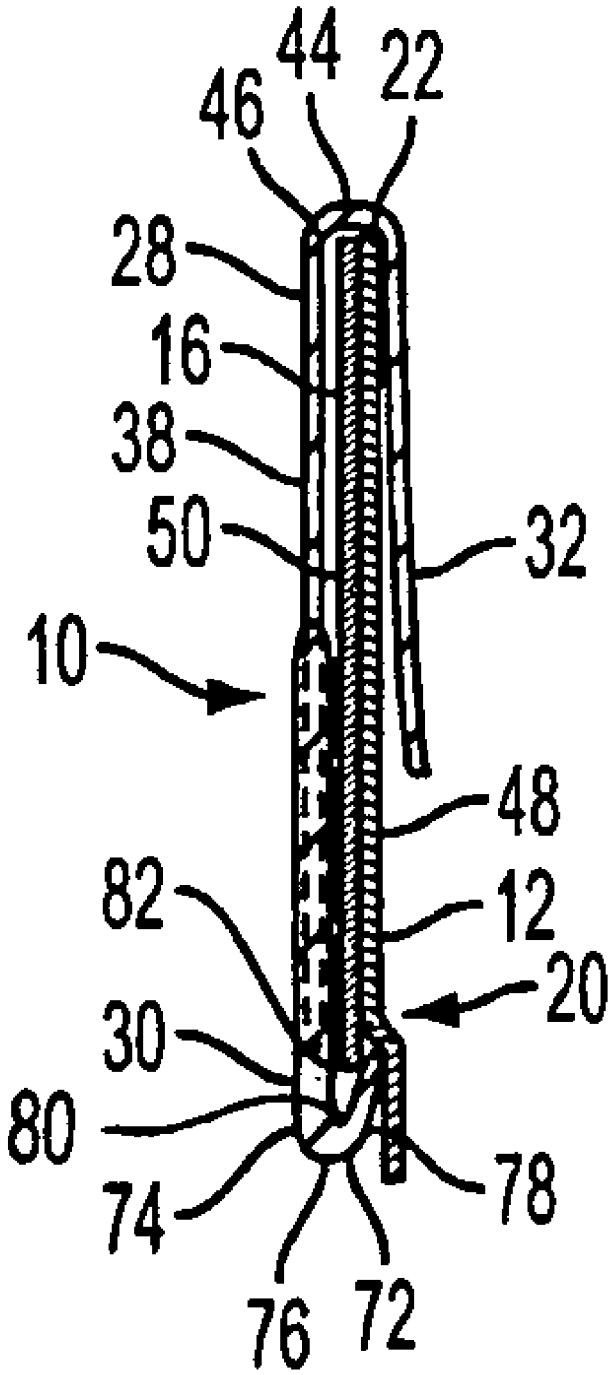
FIG. 7 is a cross sectional view along the line 7-7 in FIG. 1.

In accordance with a preferred embodiment, the first long arm 32 and the second long arm 38 are spaced sufficiently close such that the inherent resilience of the first belt support member 28 grips the belt 16 and waistband 12 as the first belt support member 28 is placed in position over both the belt 16 and the waistband 12. In accordance with alternate embodiments and with reference to FIGS. 4A and 4B, the belt support 110, 210 includes a first belt support member 128, 228 and a second belt support member 130, 230. However, the free end 152, 252 of the first long arm 132, 232 of the belt support 110, 210 may be provided with a spring biased arm 154, 254 including either a smooth inner surface 156 (as shown with reference to the embodiment of FIG. 4A) or a ribbed (for example, alligator teeth) inner surface 256 (as shown with reference to the embodiment of FIG. 4B) to grip the inner surface 48 of the waistband 12. Similarly, and with reference to the embodiment disclosed above with reference to FIGS. 1, 2A, 2B, 3 and 7, the first long arm 32 may be provided with a smooth or ribbed (for example, with alligator teeth) inner surface 56 as shown with reference to the embodiment shown in FIGS. 4A and 4B. With reference to FIG. 5, the entire inner surface 357 of the belt support 310 may be etched 359 to improve gripping. In accordance with yet another embodiment, and with reference to FIGS. 6A, 6B, 6C and 6D the first long arm 432 of the belt support 410 may be constructed as a snap spring 457, which, as a result of its inherent bias, "snaps" between a release configuration (open as shown with reference to FIG. 6C) and securing configuration (closed as shown with reference to FIG. 6D). Such an embodiment would further include alligator teeth 461 at a free end 463 thereof for gripping.

The first belt support member 28 further includes a first telescoping member 58. In accordance with a preferred embodiment, the first telescoping member is a longitudinally extending first telescoping arm 58 formed along the second long arm 38. The first telescoping arm 58 is shaped and dimensioned for telescopically engaging the second belt support member 30.

The second belt support member 30 includes a first end 61 and a second end 62. The first end 61 of the second belt support member 30 includes the second telescoping member 60, in particular in accordance with a preferred embodiment, a longitudinally extending second telescoping recess, shaped and dimensioned for telescopically coupling with the first telescoping arm 58 of the first belt support member 28 to allow movement of the second belt support member 30 relative to the first belt support member 28.

In accordance with a preferred embodiment, the first telescoping arm 58 of the first belt support member 28 is a longitudinally extending member shaped and dimensioned for passage within a recess 64 of the second telescoping member 60. As such, the first telescoping arm 58 may be thought of as the male member in the telescoping construction and the second telescoping member 60 may be thought of as the female member of the telescoping construction. Although a preferred male member/female member construction is disclosed in accordance with a preferred embodiment of the present invention, those skilled in the art will appreciate the male/female components could certainly be switched without departing from the spirit of the present invention.

The first telescoping arm 58 is frictionally held within the recess 64 of the second telescoping member 60 in a manner allowing for the creation of frictional resistance. The frictional resistance is sufficient to hold the first belt support member 28 relative to the second belt support member 30, but permit relative movement thereof if it is desired to adjust the relative position of the first belt support member 28 and the second belt support member 30. While friction is used to hold the first belt support member 28 relative to the second belt support member in accordance with a preferred embodiment of the present invention, those skilled in the art will appreciate other frictional retaining structures, for example, a ratchet type mechanism, may be employed without departing from the spirit of the present invention.

A belt engaging flange 72 extends from the second end 62 of the second belt support member 30 and toward the second long arm 38 of the first belt support member 28. The belt engaging flange 72 is shaped and dimensioned to wrap about the belt 16 for holding it in position adjacent and parallel to the top edge 22 of a waistband 12. More particularly, the belt engaging flange 72 is substantially U-shaped and extends rearwardly, that is, toward the first long arm 32 of the first belt support member 28. With this in mind, the belt engaging flange 72 includes a front wall 74, a base 76 and a rear wall 78 forming a recess 80 shaped and dimensioned for receiving and supporting a belt 16. In particular, and as will be discussed below in greater detail, the lower edge 82 of the belt 16 is placed within the recess 80 such that the rear wall 78 is positioned along the inner surface 84 of the belt 16, the front wall 74 is positioned along the outer surface 50 of the belt 16 and the base 76 supports the lower edge 82 of the belt 16. In this way the belt 16 sits within the recess 80 and is supported against downward movement.

Because the belt support 10 is composed of the first belt support member 28 and the second belt support member 30, which are relatively moveable, the first belt support member 28 and the second belt support member 30 may be manufactured in a variety of manners to keep the pieces from separating. It is contemplated one mechanism for preventing separation is to utilize a crimp 88 along the second telescoping member 60 of the second belt support member 30 (see FIG. 3). Once the first telescoping arm 58 is inserted into the second telescoping member 60, the second telescoping member 60 can be crimped at the outer end 86 to form a crimp 88 which engages a detent 66 along the first telescoping arm 58 and prevent the first telescoping arm 58 from being pulled therefrom.

As briefly discussed above, the present belt support 10 can be used in conjunction with any type of belt, for example, dress belts, utility belts, etc., for pants, skirts, or other forms of clothing that utilize belts. In addition, the belt support 10 works in conjunction with belts made from a variety of materials, including, but not limited to fabric, leather, plastic or other suitable belt making materials. In addition, the present belt support 10 can be made from a variety of materials. For example, it is contemplated the belt support 10 may be manufactured from metal, plastic or any other suitable material.

Ultimately, and as will be described below in greater detail, the belt support 10 holds a belt 16 parallel, and adjacent, to the top edge 22 of a waistband 12 of pants, skirts, or other forms of clothing 20 utilizing belts. As such, the belt 16 and belt buckle 18 are prevented from sagging downwardly under their weight. The belt support 10 holds the belt 16 parallel to the top edge 22 of the waistband 12 through a recess 46 at the top of the first belt support member 28 and the belt engaging flange 72 of the second belt support member 30. The pressure of the belt support 10 squeezing the belt 16 and waistband 12 between the first long arm 32 and second long arm 38 of the first belt support member 28, combined with the gripping along the inner surface 48 of the pants 20 and outer surface 50 of the belt 16 allows for the belt 16 to be held in position at a place adjacent to and parallel to the top edge 22 of a waistband 12.

The general mechanics of the present belt support 10, as described above, and with reference to the various figures, incorporates a first belt support member 28 and a second belt support member 30 that permit adjustment to accommodate various belt widths. In practice, the user will put on his or her pants 20 and put a belt 16 on in a traditional manner. Thereafter, the belt support 10 is stretched to a fully extended orientation with the first belt support member 28 and second belt support member 30 pulled apart as far as allowed based upon the crimp 88. The belt support 10 is then passed over the waistband 12 and the belt 16 until the recess 46 of the first belt support member is adjacent the top edge 22 of the waistband 12 with the belt 16 and waistband 12 held between the first long arm 32 (along the inner surface 48 of the waistband 12) and the second long arm 38 (along the outer surface 50 of the belt 16). The second belt support member 30 is then moved toward the first belt support member 28 closing the space between the recess 46 of the first belt support member 28 and the belt engaging flange 72 of the second belt support member 30 until the belt engaging flange 72 comes into contact with the lower edge 82 of the belt 16 as it is held in a desired position along the waistband 12. The interaction of the retaining members of the first telescoping arm 58 and the second telescoping member 60 then holds the belt support 10 in this orientation with the belt 16 held in a desired position.

The second telescoping member 60 of the second belt support member 30 permits adjustment of the first and second belt support members 28, 30 relative to each other to accommodate belts of varying widths with the first belt support member 28 bending over and securing the belt 16 to the top edge 22 and inner surface 48 of the waistband 12 of the pants 20 so the belt 16 and upper edge 24 of the pants 20 remain parallel to each other. Although the belt support 10 is particularly adapted for use at the front of the belt 16, it can be used anywhere around belt 16 with the same functionality in mind, securing the top of a belt 16 parallel to the upper edge 24 of the pants 20.

As mentioned above, the belt support 10 can be made out of metal, plastic, or other suitable material. The colors can range from metallic silver, gold, brass, dark brass and rust for metal. It is also contemplated belt supports matching the variety of belt buckles currently on the market, or any other color, depending on materials used to manufacture the belt 16 such as plastics, or plastic/rubber coatings can be utilized.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A belt support for supporting a belt in position along a waist band adjacent a wait band clasp, comprising:

a first belt support member and a second belt support member telescopically coupled to the first belt support member for movement relative thereto;

the first belt support member including a substantially straight first long arm having a first end and a second end, a substantially straight second long arm having a first end and a second end, a first connecting member coupled between the second end of the first long arm and the second end of the second long arm with the first long arm and the second long arm substantially parallel, the first long arm, second long arm and connecting member forming a recess, shaped and dimensioned for receiving a waist band and belt adjacent a waist band clasp;

the first belt support member including a first telescoping member formed along the second long arm;

the second belt support member including a first end and a second end, the first end of the second belt support member is coupled to the second long arm of the first belt support member for controlled telescopic movement of the first belt support member relative to the second belt support member, wherein the first end of the second belt support member includes a second telescoping member telescopically coupled to the first telescoping member of the first belt support member to allow movement of the second belt support member relative to the first belt support member; a belt engaging flange extends from the second end of the second belt support member and toward the second long arm of the first belt support member, the belt engaging flange is shaped and dimensioned to wrap about the belt for holding it in position adjacent the waist band;

wherein the first telescoping member of the first belt support member frictionally engages the second telescoping member of the second belt support member for permitting controlled adjustment of the second belt support member relative to the first belt support member.

2. The belt support according to claim 1, wherein the first belt support member is resilient.

3. The belt support according to claim 1, wherein the first end of the first long arm includes spring biased arm.

4. The belt support according to claim 3, wherein the spring biased arm includes a smooth inner surface.

5. The belt support according to claim 3, wherein the spring biased arm includes a ribbed inner surface.

6. The belt support according to claim 1, wherein the first telescoping member is a longitudinally extending first telescoping arm.

7. The belt support according to claim 6, wherein the second telescoping member includes a recess shaped and dimensioned for receiving the first telescoping arm.

8. The belt support according to claim 7, wherein the first telescoping arm includes a detent shaped and dimensioned to engage a crimp along the second telescoping member for preventing separation of the first telescoping arm from the second telescoping member.

9. The belt support according to claim 1, wherein the belt engaging flange includes a front wall, a base and a rear wall forming a recess.

* * * * *